United States Patent [19]

Rachocki

[11] Patent Number: 4,911,487

[45] Date of Patent: Mar. 27, 1990

[54] ROTARY PADDLE LATCH

[75] Inventor: Michael J. Rachocki, Olmsted Falls, Ohio

[73] Assignee: Cleveland Hardware & Forging Co., Cleveland, Ohio

[21] Appl. No.: 100,569

[22] Filed: Sep. 24, 1987

Related U.S. Application Data

[63] Continuation-in-part of Ser. No. 861,901, May 12, 1986, abandoned.

[51] Int. Cl.[4] ..... E05C 3/06

[52] U.S. Cl. ..... 292/216; 292/DIG. 31; 70/472; 70/208

[58] Field of Search ..... 292/216, 0.31, 210, 292/280, 337, DIG. 65, 240, 245; 70/472, 208

[56] References Cited

U.S. PATENT DOCUMENTS

| | | | |
|---|---|---|---|
| H358 | 11/1987 | Kaveney, Jr. | 292/216 |
| 2,634,147 | 4/1953 | Robertson | 292/216 |
| 2,877,038 | 3/1959 | Kramer | 292/216 |
| 3,384,404 | 5/1968 | Slattery | 292/210 X |
| 3,758,140 | 9/1973 | Prete, Jr. | 292/223 |
| 3,844,593 | 10/1974 | Slattery | 292/48 |
| 3,905,624 | 9/1975 | Fujita | 292/216 X |
| 4,138,869 | 2/1970 | Pelcin | 70/151 R |
| 4,172,768 | 10/1979 | Cerdan | 292/216 |
| 4,203,621 | 5/1980 | Noel et al. | 292/216 |
| 4,231,597 | 11/1980 | Pelcin | 292/164 |
| 4,312,202 | 1/1982 | Pastva, Jr. | 70/472 |
| 4,312,204 | 1/1982 | Davis | 70/472 |
| 4,312,205 | 1/1982 | Reed et al. | 70/472 |
| 4,320,642 | 3/1982 | Pastva, Jr. | 70/472 |
| 4,321,812 | 3/1982 | Pelci | 70/472 |
| 4,438,964 | 3/1984 | Peters | 292/216 |
| 4,703,961 | 11/1987 | Weinerman et al. | 292/216 |

FOREIGN PATENT DOCUMENTS

| | | | |
|---|---|---|---|
| 2721979 | 11/1978 | Fed. Rep. of Germany | 292/216 |
| 2424392 | 12/1979 | France | 292/216 |
| 0029023 | 3/1977 | Japan | 292/216 |
| 1574763 | 9/1980 | United Kingdom . | |

OTHER PUBLICATIONS

Specification sheet for compact rotary slam latch, Eberhard Mfg. Co. (1986).

Drawing dated 1-3-79 by Trimark Corp. for rotary hook latch/linkage assembly.

Brochure, "7-10 Series Single rotary compartment latch", Trimark Corp. (1982).

*Primary Examiner*—Gary L. Smith

*Assistant Examiner*—Eric K. Nicholson

*Attorney, Agent, or Firm*—Calfee, Halter & Griswold

[57] ABSTRACT

The rotary paddle latch of the present invention has a latched position, an intermediate safety position and an unlatched position and includes an assembly for locking the external rotary paddle while permitting an optional internal handle to override the lock to move the latch to its unlatched position. The rotary paddle latch assembly includes a pivotally mounted latch bar pivotally actuated by the external rotary paddle, a spring biased, pivotally mounted tripping pawl selectively pivotally actuated by the latch bar or by the optional internal handle, a pivotally mounted stepped cam having an abutment surface engaged by said tripping pawl, and a spring biased, pivotally mounted latch plate having a throat therein for receiving a striker bar. The latch plate includes a cam follower riding along the stepped cam when the tripping pawl is moved to allow pivotal movement of the latch plate between the three latch positions. The rotary paddle latch includes a support bracket for mounting the latch plate and cam and a shield mounted on said bracket including a groove cooperating with the latch plate throat to surround the striker bar in the latched and intermediate positions. All components of the latch are universally configured for left or right hand doors.

23 Claims, 3 Drawing Sheets

ROTARY PADDLE LATCH

CROSS REFERENCE TO RELATED APPLICATION

This disclosure is a continuation-in-part of U.S. patent application Ser. No. 861,901, filed May 12, 1986 which is now abandoned.

FIELD OF THE INVENTION

The present invention generally relates to a rotary paddle latch for use on vehicle doors.

BACKGROUND OF THE INVENTION

Rotary paddle latches are often used on vehicle storage doors. Rotary paddle latches may also be used for personnel doors on vehicles committed to off-road or non-highway use. An example of a rotary paddle latch is shown in Peters U.S. Pat. No. 4,438,964.

The latch mechanism shown in Peters patent includes a latch bar rectilinearly sliding perpendicular to the plane of rotation of a pivotally mounted, spring biased latch plate. The latch plate has a cam thereon cooperating with the forward end of the sliding latch bar selectively to hold the latch plate in one of three positions. The other end of the Peters latch bar has an abutment thereon selectively engaged by a locking bar in its locked position to preclude sliding movement. The rotary latch structure of the Peters patent includes certain manufacturing and operational disadvantages.

For example, the pivotal latch plate in Peters is pivotally mounted directly to the latch body pan in an off-center position. This off-center pivotal mounting of the latch plate requires separate parts to be made for left and right vehicle doors or requires the striker bar to be mounted at different relative vertical positions on the left and right doors. The pivotal mounting of the latch plate directly to the latch body pan may not provide the structural integrity required since the latch plate is repeatedly subjected to door closure forces. Additionally, when the door is open, the Peters latch bar is held in its retracted position by the latch plate being pivoted to an unlatched position across the latch bar's path of travel. In this position, the latch bar abutment blocks the latching bar from being moved into its locked position.

Other rotary paddle latch mechanisms are shown in the prior art cited in the Peters patent. Particular attention is directed to the refrigerator latch shown in Burke U.S. Pat. No. 2,767,007 which includes a spring biased, pivotally mounted latch bolt cooperating with a pivotally mounted spring biased latch operating cam.

A number of paddle latches are disclosed in U.S. patents issued to The Eastern Company. Generally these latches include a "disconnect" mechanism that connects or disconnects the paddle from the latching mechanism according to whether or not the latch is unlocked or locked, respectively. U.S. Pat. No. 4,320,642 discloses such a paddle latch. In FIGS. 14–24 of that patent, a latch having an engaging latch plate and cam is shown. In that latch, the striker bar is encountered on one side of the latch plate opposite the cam. In U.S. Pat. No. 2,634,147 to Robertson a latch is disclosed having a stepped cam on a tripping pawl and a cam follower on a latch plate.

SUMMARY OF THE INVENTION

A principal object of the present invention is to provide a rotary paddle latch having universal application to left and right hand doors with the striker bar being securely retained in the latched position. To accomplish this purpose, the striker bolt is received along the center line of the latch and is cooperatively surrounded by a latch plate recess and a groove in a support bracket.

It is another object of the present invention to provide a rotary paddle latch that may be locked in any position of the door or latch plate. The lock assembly cooperates with a pivotal latch bar that permits the lock to be moved to its locked position irrespective of the latch plate position.

It is still another object of the present invention to provide a rotary paddle latch including a manual internal override of the lock. The pivotal tripping pawl controlling movement of the latch plate toward its unlatched position may be independently actuated by an internal handle manually to override the lock assembly.

It is yet another object of the present invention to provide a rotary paddle latch providing increased security for vehicle storage compartments by omitting the internal handle and enclosing the latch components. A support bracket and shield have the latch assembly components internally mounted therebetween to provide increased latch strength and to enclose the latch assembly components. The support bracket and shield thus enhance latch life and shield the latch assembly components from shifting loads in the compartment which might otherwise inadvertently actuate the latch to open the door.

The invention, then, comprises the features hereinafter fully described and particularly pointed out in the claims, the following description and annexed drawings setting forth in detail certain illustrative embodiments of the invention, these being indicative, however, of but a few of the various ways in which the principles of the invention may be embodied.

DETAILED DESCRIPTION

Figure 1:
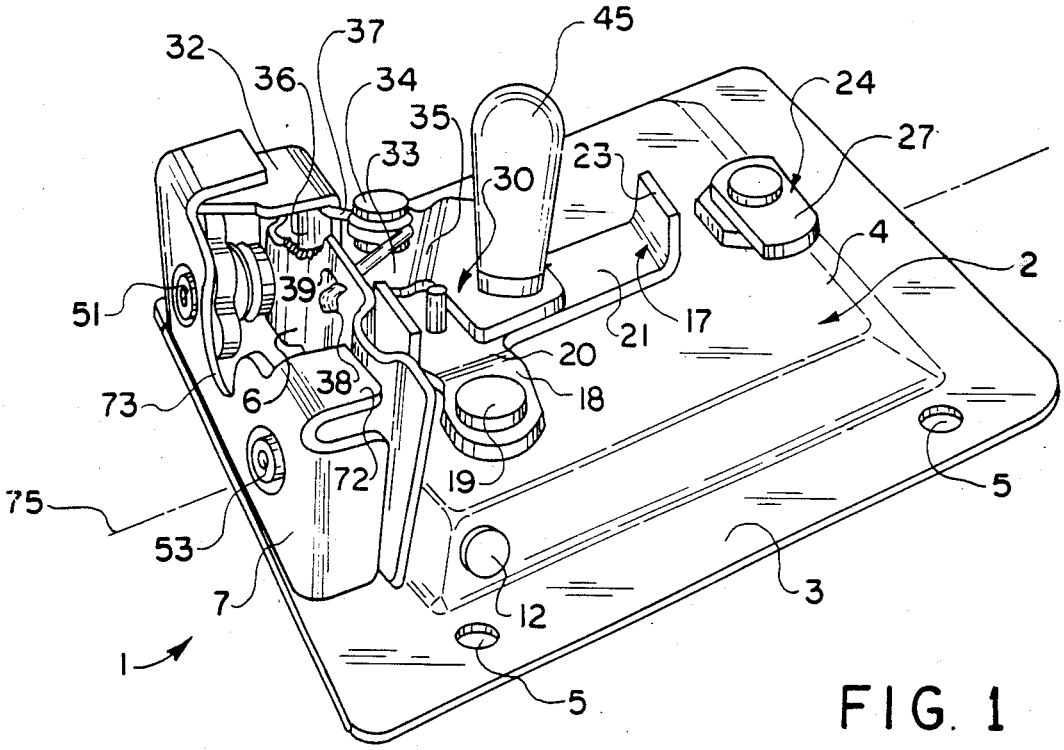
FIG. 1 is a perspective view of the inside of an unlocked rotary paddle latch assembly according to the invention with the latch plate in its unlatched position.

Referring now in more detail to the drawings and initially to FIGS. 1, 2, 5 and 6, the rotary paddle latch according to the present invention indicated generally at 1 includes a latch body 2 having a peripheral attachment flange 3 and a well or pan 4. Peripheral attachment flange 3 has holes 5 proximate each of its corners. A support bracket indicated generally at 6 is rigidly mounted, for example by welding, on the inside surface of the well base wall. A shield 7 attached to support bracket 6 forms a housing for a latch plate and cam described below. Well 4, support bracket 6 and shield 7 of latch 1 are received in a recess in the panel of vehicle door 8. Latch body 2 is secured to door 8 by standard fastening methods such as fasteners passing through holes 5 in the peripheral attachment flange or welded threaded studs.

Door 8 is hinged to the door frame of the vehicle as shown at 9 selectively allowing the door to be swung between open and closed positions. When the door is closed, rotary paddle latch 1 cooperates with a striker bar 10 mounted on the door frame to retain the door in its closed position. To open the door, the rotary paddle latch may be unlatched from inside door 8 regardless of whether latch 1 is locked or unlocked. The latch may be externally unlatched, if unlocked, to allow the door to be swung to its open position as described in detail below.

Figure 4:
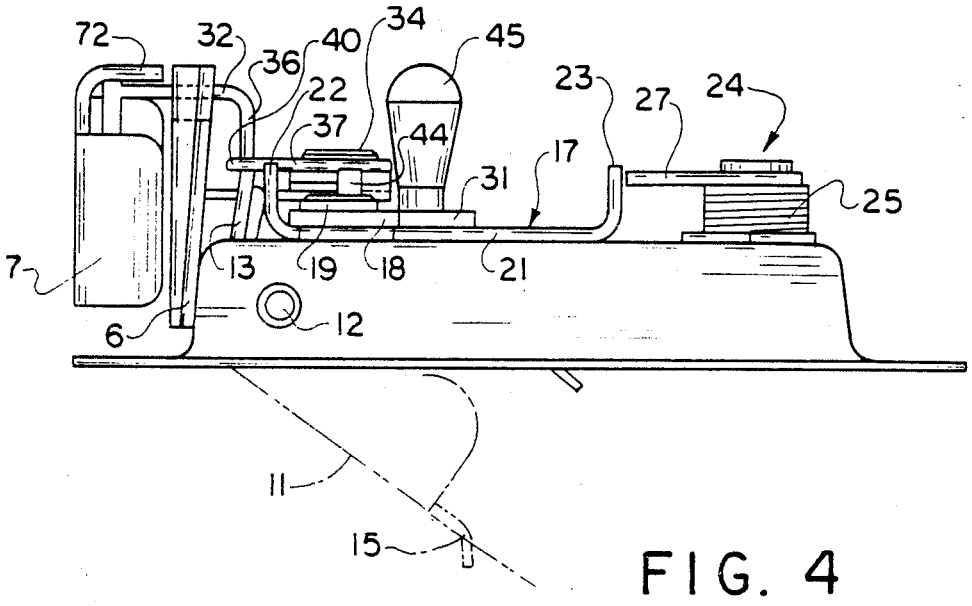
FIG. 4 is a side elevation of the rotary paddle latch of FIG. 1 with the lock in its locked position.
Figure 5:
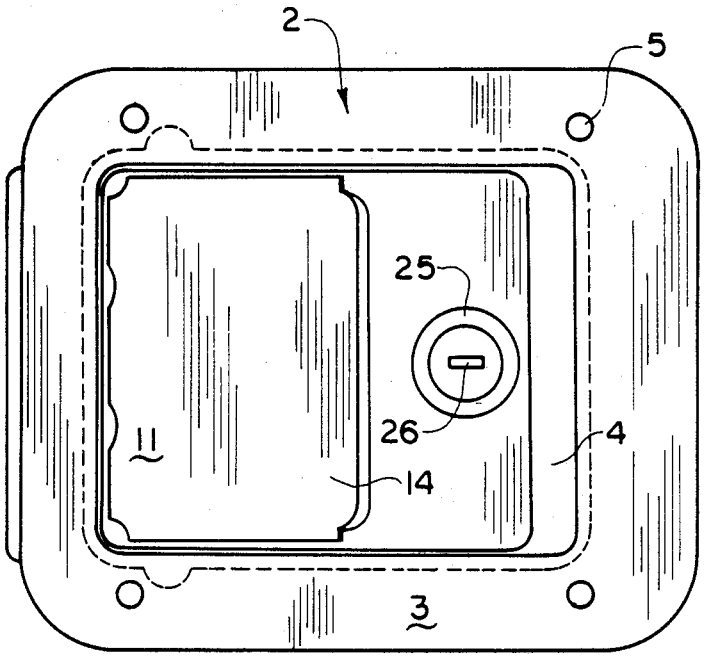
FIG. 5 is a bottom view of the rotary paddle latch of FIG. 1.
Figure 6:
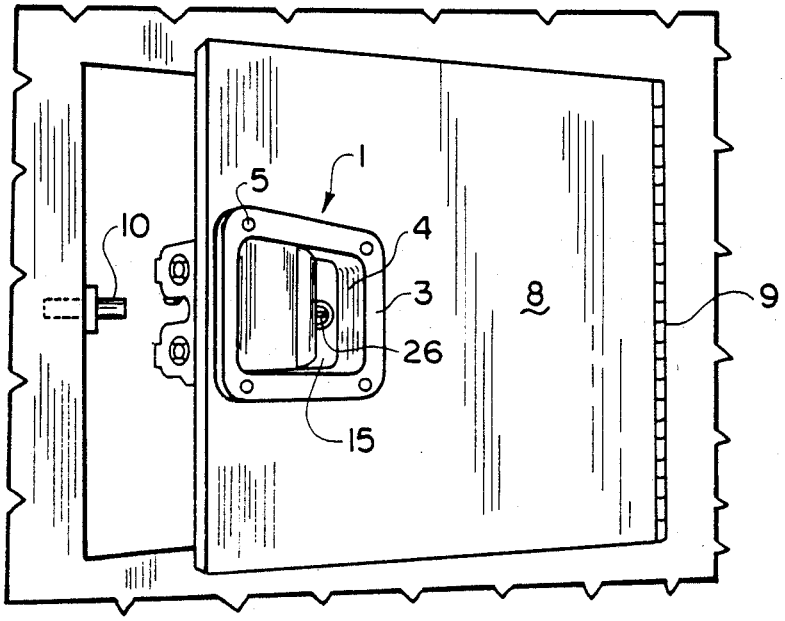
FIG. 6 is a perspective view of the rotary paddle latch of FIG. 1 mounted on a partially open vehicle door.

The external rotary paddle 11 is normally received in the pan 4 of latch body 2 as best shown in FIGS. 5 and 6. The rotary paddle handle is pivotally connected to the side walls of the latch body well 4 by a pivot shaft 12. The proximal end of rotary paddle 11 has an inwardly bent tongue 13 extending through an elongated rectilinear slot 14 in the base wall of well 4. The distal end of handle 11 is provided with an outwardly turned gripping portion 15 to assist the operator in manually gripping the rotary paddle 11 to pivot the same outwardly around pivot shaft 12. Rotary paddle 11 may be spring_biased in conventional fashion to return to its normal position nested in the latch body pan or well 4. Outward pivotal actuation of handle 11 results in tongue 13 moving rearwardly (to the right in FIGS. 1 and 4) in slot 14 to actuate a latch bar 17, if the latch is unlocked.

Latch bar 17 has a generally L-shape configuration and is pivotally mounted relative to the latch body 2. To this end, a first leg 18 of the latch bar 17 is pivotally connected adjacent its end to pan 4 by a rivet 19. Leg 18 of latch bar 17 is bent outwardly relative to the vehicle door as shown at 20 to place the other leg 21 of latch bar 17 more closely adjacent the base wall 4 of latch body 2.

Second leg 21 of latch bar 17 has an inwardly turned actuation tab 22 on its forward end. Tab 22 is selectively engaged and driven by tongue 13 on rotary paddle 11 as will be described in more detail below. The rear end of leg 21 of latch bar 17 has an inwardly turned abutment shoulder 23 selectively cooperating with a lock assembly, indicated generally at 24.

Lock assembly 24 includes a locking cylinder 25 fixedly secured to and extending through the base wall of well 4. A key slot 26 in the locking cylinder is flush with the outside surface of the base wall of well 4. A key may be inserted into key slot 26 from outside door 8 and turned through a 90° arc. Turning the key received in the key slot results in a locking bar 27 on the inside of the latch being reciprocally arcuately moved between the unlocked position shown in FIGS. 1 and 2 and the locked position shown in FIG. 4. In the locked position, the end of locking bar 27 either bears against or is in close proximity to the abutment shoulder 23. Locking bar 27 in its locked position against abutment flange 23 precludes any movement in latch bar 17. The locked position of lock 24 precludes rotary paddle 11 from pivotally moving latch bar 17 about its pivot 19, thereby precluding movement of a tripping pawl 30.

Figure 2:
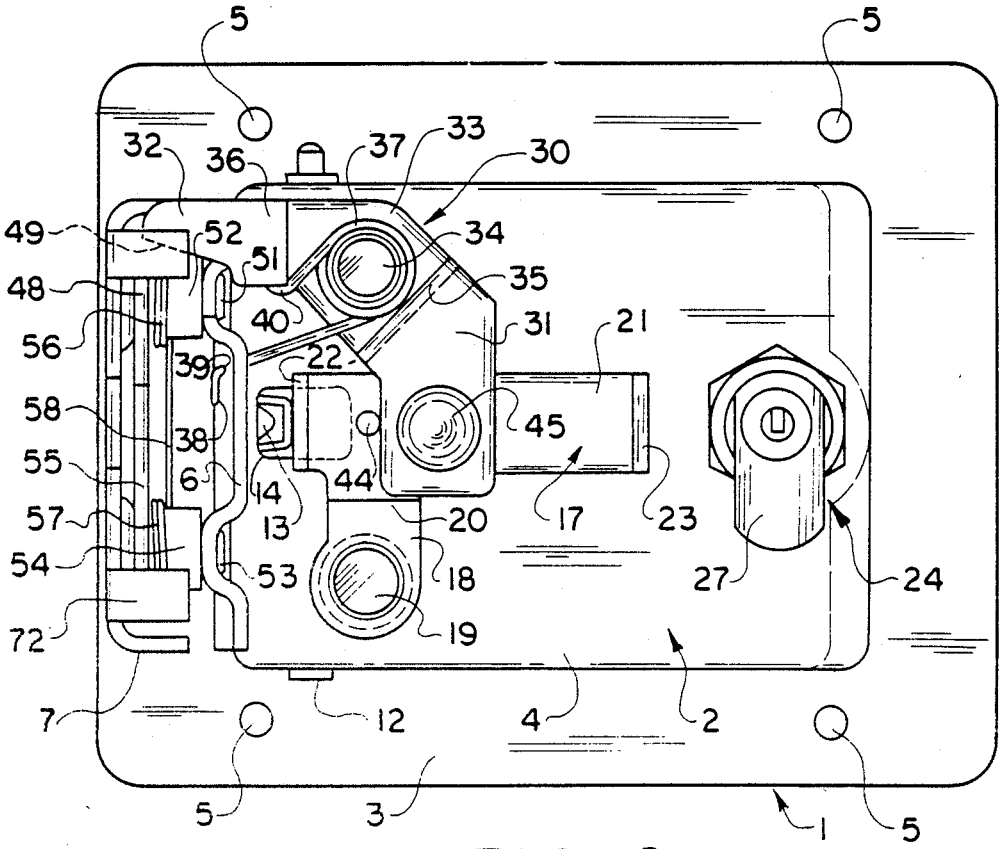
FIG. 2 is a plan view of the inside of the rotary paddle latch of FIG. 1

Tripping pawl 30 principally lies in two planes and is generally L-shape in the plan view of FIG. 2 and in the side view of FIG. 4. Tripping pawl 30 has a first leg 31, a second leg 32, and a central portion 33 joining legs 31 and 32. Central portion 33 is pivotally mounted relative to the latch body 2 by a rivet 34 attached to pan 4. First leg 31 is bent outwardly at 35 relative to pan 4 so that leg 21 of latch bar 17 is disposed between leg 31 and pan 4. Connecting portion 36 joins second leg 32 to central portion 33. Connecting portion 36 projects outwardly from pan 4.

Tripping pawl 30 is spring biased by a coil spring 37 wound around the elongated head of pivot rivet 34. Coil spring 37 biases tripping pawl 30 in a clockwise direction as viewed in FIG. 2. An end 38 of coil spring 37 is secured in a hole 39 in support bracket 6, with the other end 40 of spring 37 bearing on connecting portion 36 of tripping pawl 30 to impart the clockwise bias to the tripping pawl.

The spring bias of tripping pawl 30 normally maintains a drive connection between latch bar 17 and tripping pawl 30. To this end, the base of the L-shape latch bar 17 has a drive pin 44 thereon extending outwardly with respect to pan 4. Drive pin 44 normally engages first leg 31 of tripping pawl 30, leg 31 overlying latch bar 17. Thus, arcuate movement of latch bar 17 about its pivot 19 will drive tripping pawl 30 in the opposite arcuate direction through the drive connection provided by drive pin 44 engaging the first leg 31. This pivotal movement of latch bar 17 may be produced by tongue 13, i.e. by actuating paddle 11 when lock 24 is unlocked.

Pivotal movement of tripping pawl 30 about its pivot 34 can also be obtained independently of the latch bar 17 by an internal handle 45. Internal handle 45, which may be provided for personnel doors or removed for storage doors, is removably mounted on first leg 31 of tripping pawl 30. Handle 45 permits a vehicle occupant manually to actuate the latch by pivoting tripping pawl 30 in counterclockwise direction for resultant movement of a cam 48.

Figure 3A:
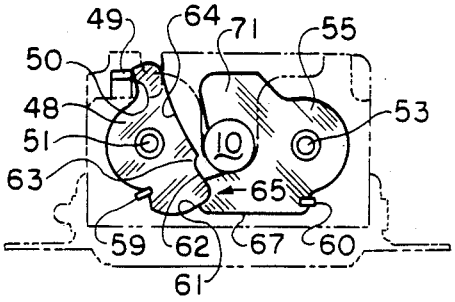
FIG. 3A, 3B and 3C are partial sectional views of the inside of the rotary paddle latch assembly with the housing not shown taken along line 3—3 of FIG. 2 with the latch plate in its latched, intermediate and unlatched positions, respectively.
Figure 3B:
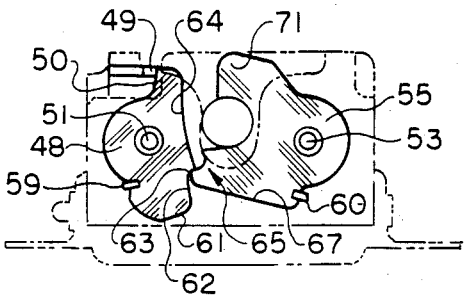
Figure 3C:
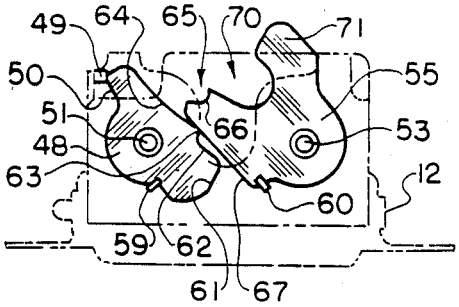

The distal end of second leg 32 of tripping pawl 30 is provided with a surface 49 for engaging an abutment surface 50 of cam 48. Cam 48 is pivotally mounted on a rivet 51 mounted in support bracket 6 and shield 7. A spacer 52 on rivet 51 separates bracket 6 from shield 7. A second rivet 53 is also mounted on support bracket 6 and shield 7 with a spacer 54 mounted on rivet 53 between the bracket and shield. A latch plate 55 having a stepped cam follower is pivotally mounted on rivet 53. One of the coils 56 and 57 of a continuous two coil spring 58 is mounted about each of spacers 52 and 54, respectively. As best seen in FIGS. 3A, 3B and 3C, one end 59 of spring 58 engages a notch in cam 48 to apply a bias turning cam 48 counterclockwise, as viewed in FIGS. 3A–3C. The other end 60 of spring 58 engages a notch in latch plate 55 to apply a clockwise bias to latch plate 55. This bias ensures engagement of cam 48 with the stepped cam follower on latch plate 55.

Cam 48 has two steps, one defined by the outside corner formed by the intersection of surfaces 61 and 62 on cam 48, and another defined by the cusp formed by the intersection of surfaces 62 and 63 on cam 48. Surface 64, adjoining surface 63, provides a sliding surface on cam 48. The corners and sliding surfaces on cam 48 are engaged by a cam follower 65 on latch 55. Cam follower 65 includes an inside corner 66 for engaging the corner and cusp on cam 48. A surface 67 on follower 65 adjoining corner 66 is provided for sliding along surface 64 of cam 48.

Latch plate 55 includes a throat 70, an ear 71 of latch plate 55 protrudes to engage a stop 72 on shield 7 to limit clockwise rotation of latch plate 55. Shield 7 also includes a centered groove 73 for receiving a striker bar and that aligns with throat 70 when latch assembly 1 is latched.

Although the operation of the rotary paddle latch of the present invention is believed apparent from the above description, the operation of the paddle latch of the present invention is briefly described below. When door 8 is closed, latch plate 55 is in its fully latched position. Locking bar 27 may be in its locked position, all as illustrated in FIGS. 3A and 4. Inside corner 66 of cam follower 65 engages the outside corner of surfaces 61 and 62 of cam 48 and holds the latch plate in its fully latched position as shown in FIG. 3A. In that position, throat 70 of latch plate 55 fully receives striker bar 10. Striker bar 10 is also received in centered groove 73 in shield 7. Striker bar 10 is disposed between cam 48 and latch plate 55 in throat 70 and groove 73 when the latch is in its latched position. Throat 70 and groove 73 cooperate substantially to surround and enclose striker bar 10 to provide a secure connection between latch 1 and striker bar 10.

If a person outside the vehicle attempts to open door 8 without a key, external rotary paddle 11 cannot be pivotally actuated because the locking bar 27 engages abutment flange 23 on latch bar 17 and prevents pivotal movement of the latch bar and the rotary paddle 11.

However, the locked position of lock 27 may be manually overriden from inside the vehicle. An occupant may grasp handle 45 and pivot the same in a counterclockwise direction, as viewed in FIG. 2. This actuation will result in tripping pawl 30 urging abutment surface 49 of cam 48 so that cam 48 is pivoted in a clockwise direction. Cam follower 65 disengages from cam 48 resulting in the latch plate pivotally moving in a clockwise direction as the cam follower goes from the corner to the cusp of cam 48. This position is shown in FIG. 3B. If handle 45 is moved farther, cam follower 65 is disengaged from the cusp of cam 48. Surface 67 of latch plate 55 then engages and slides along surface 64 of cam 48 until ear 71 hits stop 72. Then latch plate 55 stops turning under the influence of the bias of spring 58, having assumed its unlatched position shown in FIG. 3C. In the unlatched position, latching throat 70 on latch plate 55 is totally removed from and is free of striker bar 10 allowing the vehicle occupant to swing the door from its closed to its open position. Latch plate 55 is held in its unlatched position by spring bias. Spring 37 returns tripping pawl 30 to its initial position when handle 45 is released.

The closed, locked and fully latched door may also be opened by an authorized person outside the vehicle having a key. The key would be inserted into the key slot 26 and rotated 90° to move the locking bar 27 from its locked position shown in FIG. 4 to its unlocked position shown in FIGS. 1 and 2. The latch bar 17 then has freedom for pivotal movement.

Thereafter, the person outside the vehicle may grasp the outwardly turned gripping flange 15 on rotary paddle 11 and pull the same outwardly to pivot around shaft 12. The inwardly extending tab 13 on rotary paddle 11 is then rearwardly pivotally moved in slot 14 to engage the actuation tab 22 and drive latch bar 17 rearwardly about its pivot 19. This pivotal movement of latch bar 17 results in drive pin 44 driving the tripping pawl 30 in an opposite arcuate direction because of its engagement with leg 31. This arcuate counterclockwise movement of the tripping pawl 30 results in the cam follower moving along the stepped cam surface as described above to pivot the latch plate 55 to its unlatched position shown in FIG. 3C. Spring 37 returns pawl 30 to its original position and also paddle 11, unless paddle 11 is also biased by another spring. The door may then be swung from its closed to its open position by the person outside the vehicle.

With the door open, the door can be locked if desired by inserting a key in keyway 26 and turning the key through a 90° arc. The locking bar will concurrently swing through a 90° arc for engaging abutment shoulder 23 with latch bar 17. If latch bar 17 happens to be displaced toward lock 24, locking bar 27 will rotate latch bar 17 about pivot 19 to return the latch bar 17 to its forward position. In any event, the engagement of locking bar 27 and latch bar 17 prevents rotation of paddle 11 around pin 12, but not the closing of the door. The door will remain locked while and after the door is closed.

When an open door 8 is closed, the trailing edge of latch plate throat 70 will forcefully strike the striker bar 10 to pivot the latch plate 55 against its spring bias. In such counterclockwise pivotal movement of the latch plate 55, cam follower 65 will ride downwardly along the stepped surface of cam 48. If the door is closed with sufficient force, latch plate 55 will move to its fully latched position of FIG. 3A with the cam follower resting in corner 66. In that position, latch throat 70 fully receives striker bar 10.

However, if the door is not closed with sufficient force, latch plate 55 will only be pivoted to its intermediate safety position, FIG. 3B, wherein latch throat 70 only partially receives striker bar 10. In the safety position, the cam follower rests upon the cusp of cam 48. The cam follower, cooperating with the cusp, holds latch plate 55 in its safety position to retain the door in its partially closed position to avoid inadvertent opening. The door may be fully closed by slamming, i.e. by applying an additional force that drives cam 48 to engage corner 66. Groove 73 in shield 7 encloses a portion of striker bar 10 in the safety position of latch plate 55 to enhance the security of the latch connection.

The rotary paddle latch of the present invention receives the striker bar along the center line 75 of the latch 1. This centered spacial relationship between the striker bar 10 and latch 1 permits the latch universally to be used either in a left or a right hand door.

It will be apparent from the foregoing that changes may be made in the details of construction and configuration without departing from the spirit of the invention as defined in the following claims. For example, the rotary paddle lock 1 may be used on storage compartment doors for vehicles. If so, the interior handle 45 would be omitted since it would not be required. Without handle 45, latch bar 17, tripping pawl 30, latch plate 55 and their associated components are substantially enclosed by support bracket 6 and shield 7 to reduce the likelihood of inadvertent unlatching caused by a sliding load in the storage compartment engaging the latch actuating components.

I claim:

1. A rotary paddle latch assembly having latched and unlatched positions for cooperating with a striker bar, said latch assembly comprising a latch body, a stepped cam pivotally mounted relative to the latch body along a first axis and including an abutment surface, a latch plate pivotally mounted relative to said latch body along a second axis and having a throat therein for receiving the striker bar in the latched position of said assembly and for releasing the striker bar in the unlatched position of said assembly, the latch plate being biased to pivot in a first pivotal direction toward the unlatched position and having a cam follower for engaging said stepped cam, said cam being biased to pivot in a second pivotal direction opposite said first pivotal direction for engaging said cam follower, the engaged striker bar being disposed between said cam and said latch plate when said latch assembly is in the latched position, a tripping pawl pivotally mounted relative to said latch body for engaging said abutment surface and pivoting said cam to disengage said cam and cam follower to release said latch assembly from the latched position, and rotary paddle means pivotally mounted relative to said latch body along a third axis for pivoting said tripping pawl to disengage said cam follower from said cam, said first and second axes being generally parallel and said third axis being substantially perpendicular to said first axis.

2. The latch assembly of claim 1 including biasing means for biasing said cam and said latch plate.

3. The latch assembly of claim 2 wherein said biasing means comprises a single spring including two coils, one of said coils being concentrically disposed about said first axis and the other of said coils being concentrically disposed about said second axis.

4. The latch assembly of claim 1 including biasing means for biasing said tripping pawl away from said abutment surface.

5. The latch assembly of claim 1 including a support bracket mounted on said latch body, said latch plate and cam being pivotally mounted on said bracket.

6. The latch assembly of claim 5 including a shield mounted on said support bracket, said latch plate and cam follower being disposed between said support and shield.

7. The latch assembly of claim 6 wherein said latch plate includes an ear adjacent said throat and said shield includes a stop means for engaging said ear to limit rotation of said latch plate.

8. The latch assembly of claim 6 wherein said shield includes a groove for accommodating a striker bar when said assembly is in its latched position.

9. The latch assembly of claim 1 wherein said rotary paddle means includes a rotary paddle and a latch bar engaged by said paddle and pivotally mounted to said latch body for pivoting said tripping pawl in response to actuation of said paddle.

10. The latch assembly of claim 9 including an actuation pin mounted on said latch bar wherein the tripping pawl has opposed legs, one leg for engaging said abutment surface and wherein said pawl is biased to engage the other leg with the actuation pin.

11. The latch assembly of claim 9 including a lock having locked and unlocked positions and a rotatable lock bar and said latch bar has opposed first and second legs, one leg of the latch bar cooperating with the rotary paddle to pivot the latch bar upon rotary paddle actuation and said other leg abutting said locking bar to preclude latch bar movement when the lock is in its locked position.

12. The latch assembly of claim 1 wherein the latch plate throat has a leading edge and a trailing edge, the trailing edge engaging a striker bar to pivot the latch plate toward said latched position.

13. The latch assembly of claim 1 wherein said cam includes a corner and a cusp, the latch plate being held in the latched position by engagement of the cam follower with the corner on said cam.

14. The latch assembly of claim 13 wherein the assembly is held in an intermediate, safety position, between said latched and unlatched positions, by engagement of said cam follower with said cusp, said latch plate throat partially surrounding and retaining a striker bar in said safety position.

15. The latch assembly of claim 13, said cam including a sliding surface, said cam follower engaging said sliding surface when said assembly is in said unlatched position.

16. The latch assembly of claim 1 including a lock having locked and unlocked positions and precluding actuation of the rotary paddle means when said lock is in its locked position.

17. A rotary paddle latch cooperating with a striker bar comprising a latch body, a support bracket fixedly mounted on the latch body, an L-shape latch bar pivotally mounted on the latch body, a tripping pawl pivotally mounted on the support bracket and having opposed legs, an actuation pin mounted on the latch bar, the tripping pawl being spring biased normally to have one leg thereof engage the actuation pin, a stepped cam pivotally mounted on said support and having an abutment surface, said cam being spring biased so that said abutment surface is engaged by a leg of said tripping pawl, a latch plate pivotally mounted on the support bracket and having a throat therein for receiving the striker bar, the latch plate having a first latched position in which the striker bar is received between the cam and latch plate in the throat and a second unlatched position in which the striker bar is entirely free of the throat, the latch plate being spring biased toward its unlatched position, a cam follower on the latch plate engaging the cam, a rotary paddle for pivoting the latch bar and actuation pin in a first pivotal direction and thereby pivoting the tripping pawl in a second pivotal direction opposite said first pivotal direction against its bias to pivot the stepped cam and release engagement of the cam and the cam follower, the cam follower riding along the stepped cam under the influence of the latch plate bias to pivot the latch plate toward its unlatched position, and a lock mounted on the latch body, the lock having a locked position and an unlocked position respectively to preclude or permit pivotal latch bar movement, the tripping pawl including a handle mounted on the tripping pawl to permit pivotal movement of the tripping pawl upon handle actuation independently of actuation of the rotary paddle and the latch plate to override the lock when the lock is in its locked position.

18. The rotary paddle latch of claim 17 wherein the rotary paddle handle has a tongue and the latch bar has a leg with opposed first and second ends, one end engaged and moved by the tongue and has the other end selectively abutted by a locking bar to preclude latch bar movement when the lock is in its locked position.

19. A rotary paddle latch for mounting on a vehicle door selectively cooperating with a striker bar mounted on a frame for the vehicle door for latching the door to keep it closed and for unlatching the door for opening it, comprising a latch body secured in a vehicle door, a rotary paddle handle pivotally mounted on the latch body on the outside of the door, a latch bar pivotally mounted relative to the latch body on the inside of said door and pivotally actuated by the rotary paddle handle, a spring biased tripping pawl pivotally mounted relative to the latch body on the inside of said door and having a handle mounted thereon extending from the pawl on the inside of the door, the tripping pawl being selectively pivotally actuated for unlatching the door by the outside rotary paddle or by the inside handle, a spring biased stepped cam pivotally mounted relative to the latch body and having an abutment surface engaged by the tripping pawl, a spring biased latch plate pivotally mounted relative to the latch body and having a throat therein for receiving the striking bar in the latched position when the door is closed and for releasing the striking bar in the unlatched position when the door is open or being opened, and a cam follower on the latch plate engaging the stepped cam, said cam lying to one side of, and said latch plate lying to an opposite side of, said striking bar when said striking bar is in the latched position, whereby movement of the stepped cam by actuation of the tripping pawl results in the cam follower riding along the surface of the stepped cam pivotally to move the spring biased latch plate toward its unlatched position to allow the door to be opened, whereby pivotal movement of the latch plate toward its latching position when the recess receives the striking bar upon closing the door results in the cam follower moving along the stepped cam in an opposite direction, and whereby the stepped cam and cam follower cooperate to hold the latch plate in its selected position when the door is closed or open.

20. A rotary paddle latch assembly having latched and unlatched positions for cooperating with a striker bar, said latch assembly comprising a latch body, a stepped cam pivotally mounted relative to the latch body along a first axis and including an abutment surface, a latch plate pivotally mounted relative to said latch body along a second axis and having a throat therein for receiving the striker bar in the latched position of said assembly and for releasing the striker bar in the unlatched position of said assembly, said latch plate being biased to pivot in a first pivotal direction toward the unlatched position and having a cam follower for engaging said stepped cam, said cam being biased to pivot in a second pivotal direction opposite said first pivotal direction for engaging said cam follower, the engaged striker bar being disposed between said cam and said latch plate when said latch assembly is in the latched position, a tripping pawl pivotally mounted relative to said latch body for engaging said abutment surface and pivoting said cam to disengage said cam and said cam follower to release said latch assembly from the latched position, a support bracket mounted on said latch body and a shield mounted on said support bracket, said latch plate and said cam being pivotally mounted on said support bracket between said support bracket and said shield, said shield including a groove for accommodating said striker bar when said assembly is in its latched position, said latch body having a centerline and said groove being centrally disposed relative to said centerline, and rotary paddle means pivotally mounted relative to said latch body along a third axis for pivoting said tripping pawl to disengage said cam follower from said cam.

21. A rotary paddle latch assembly having latched and unlatched positions for cooperating with a striker bar, said latch assembly comprising a latch body, a stepped cam pivotally mounted relative to said latch body along a first axis and including an abutment surface, a latch plate pivotally mounted relative to said latch body along a second axis and having a throat therein for receiving the striker bar in the latched position of said assembly and for releasing the striker bar in the unlatched position of said assembly, said latch plate being biased to pivot in a first pivotal direction toward the unlatched position and having a cam follower for engaging said stepped cam, said cam being biased to pivot in a second pivotal direction opposite said first pivotal direction for engaging said cam follower, the engaged striker bar being disposed between said cam and said latch plate when said latch assembly is in the latched position, a tripping pawl pivotally mounted relative to said latch body for engaging said abutment surface and pivoting said cam to disengage said cam and cam follower to release said latch assembly from the latched position, rotary paddle means pivotally mounted relative to said latch body along a third axis for pivoting said tripping pawl to disengage said cam follower from said cam, and a handle mounted on said tripping pawl for pivoting said tripping pawl independent of said rotary paddle means.

22. The latch assembly of claim 21 wherein said rotary paddle means includes a rotary paddle and a latch bar engaged by said paddle and pivotally mounted to said latch body for pivoting said tripping pawl in response to actuation of said paddle.

23. The latch assembly of claim 22 wherein said latch body includes an inside surface, and an outside surface opposed to said inside surface, and said handle is disposed on one of said inside surface and said outside surface and said rotary paddle is disposed on the other of said inside surface and said outside.

* * * * *